US006896032B1

(12) United States Patent
Minor et al.

(10) Patent No.: US 6,896,032 B1
(45) Date of Patent: May 24, 2005

(54) STOPPER-POURED MOLTEN METAL CASTING VESSEL WITH CONSTANT HEAD HEIGHT

(75) Inventors: Daniel D. Minor, Cadillac, MI (US); Mark Salgat, Pinconning, MI (US); William W. Seaton, Dexter, MI (US); David Good, Chelsea, MI (US); Kenneth D. McKibben, Defiance, OH (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 10/255,306

(22) Filed: Sep. 26, 2002

(51) Int. Cl.[7] ..... B22D 37/00; B22D 41/04; B22D 41/16

(52) U.S. Cl. ..... 164/136; 164/457; 164/151.3; 164/155.2; 164/335

(58) Field of Search ..... 164/457, 155.2, 164/155.7, 151.3, 150.1, 133, 136, 335, 336, 337

(56) References Cited

U.S. PATENT DOCUMENTS

| | | | | |
|---|---|---|---|---|
| 3,729,118 A | * | 4/1973 | Wernli et al. | 222/595 |
| 3,837,531 A | | 9/1974 | Eickelberg | 222/1 |
| 4,084,631 A | * | 4/1978 | Kunzmann | 164/457 |
| 4,112,998 A | * | 9/1978 | Sato | 164/136 |
| 4,210,192 A | * | 7/1980 | Lavanchy et al. | 164/457 |
| 4,227,565 A | * | 10/1980 | Lavanchy et al. | 164/155.2 |
| 4,324,392 A | * | 4/1982 | White et al. | 266/240 |
| 4,509,578 A | * | 4/1985 | Shaw | 164/155.5 |
| 4,557,313 A | * | 12/1985 | Navarre | 164/155.5 |
| 4,724,894 A | | 2/1988 | Sjodahl | 164/457 |
| 4,744,407 A | * | 5/1988 | Fishman et al. | 164/457 |
| 5,056,584 A | * | 10/1991 | Seaton | 164/457 |
| 5,174,361 A | | 12/1992 | Kursfeld | 164/453 |
| 5,282,608 A | * | 2/1994 | Duca et al. | 266/237 |
| 5,381,855 A | * | 1/1995 | Mezger | 164/457 |
| 5,758,714 A | * | 6/1998 | Sato et al. | 164/457 |

OTHER PUBLICATIONS

Seaton et al., "Pouring Ductile Iron on a Continuous Mold Line", Foundry Management & Technology, May, 1996.
Sherman et al., "Conbraco Converts to Stopper Rod Pouring", Foundry Management & Technology, Jun., 1999.
Duca, "Horizontal Coreless Autopour for Treated Ductile Iron", American Foundry News Society, 1993.
Seaton, "Stopper Pouring of Treated Ductile Iron", Ductile Iron Society, Technical Bulletin #57, Jun., 1985.
Seaton, "Automatic Pouring of Moving Molds", American Foundrymens Society, circa 1995.
Mobl–Pour, undated Brochure, CMI–Equipment & Engineering, Inc.

* cited by examiner

*Primary Examiner*—Kevin P. Kerns
(74) *Attorney, Agent, or Firm*—MacMillan, Sobanski & Todd, LLC

(57) ABSTRACT

A casting apparatus for pouring molten metal into molds comprises a vessel having a molten metal-receiving chamber generally extending between a filling end and a pouring end. The vessel includes a nozzle disposed in a bottom surface of the chamber proximate to the pouring end. A stopper cooperates with the nozzle to control a downward gravity flow of molten metal through the nozzle. A first support pivotably supports the vessel to provide a horizontal tilt axis substantially coincident with the nozzle. A second support is connected to the vessel at a point away from the tilt axis and has a drive for controlling a pivot position of the vessel. A tilt angle controller detects a level of molten metal within the chamber and engages the drive to maintain the level at a predetermined level.

18 Claims, 8 Drawing Sheets

STOPPER-POURED MOLTEN METAL CASTING VESSEL WITH CONSTANT HEAD HEIGHT

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

Field of the Invention

The present invention relates in general to the pouring of molten metal into molds for manufacturing cast metal articles, and, more specifically, to stopper-controlled pouring of metal from a vessel wherein the flow rate of molten metal through a nozzle into a mold is accurately controlled.

One type of automated pouring device for filling casting molds with molten metal includes a stopper-controlled pouring vessel. One example of such a pouring vessel utilizing a coreless induction heater is shown in U.S. Pat. No. 5,282,608. There is an inlet for admitting molten metal into a main holding chamber within the vessel and a bottom nozzle outlet for discharging the metal into underlying casting molds. A mechanically operated stopper rod interacts with the nozzle to regulate the flow of molten metal through the nozzle.

In order to optimize the properties of the cast article, a variable flow rate into the mold is necessary. Initially during the pouring of a mold, a high rate of metal flow from the pouring vessel into the mold is desired. Metal is poured into a sprue cup formed in the top of the mold and drains from the sprue cup through passages into the mold cavity. The sprue cup must be quickly filled to provide a smooth and even flow of metal into the mold cavity. Once the level of molten metal in the sprue cup reaches the desired height, a slower rate is maintained that matches the flow of metal out of the sprue cup into the mold cavity. This rate is maintained until sufficient metal has been poured to fill the mold cavity. Preferably, the flow of metal is stopped in time to avoid overspill of metal outside the sprue cup after the mold cavity is filled.

In a conventional stopper-controlled pouring system, a variable rate of molten metal flow through the nozzle is obtained by controlling the stopper rod height over the nozzle. Specifically, the rate of flow is given by $$R=\delta A k\sqrt{2gh}$$

where R is the rate of flow in pounds/second, A is the area of the orifice between the stopper rod and the nozzle in square inches, δ is the molten metal density in pounds per cubic inch, g is the gravitational constant, h is the head height of the molten metal bath above the orifice, and k is a constant which is the product of a coefficient of velocity, a coefficient of turbulence, and a coefficient of viscosity.

In prior art stopper-controlled pouring systems, the variable A is controlled in order to achieve a desired profile of the flow rate during mold filling. The above equation is solved for A and a controller uses a known target flow rate at any moment together with nominal constant values for δ and k in order to determine the appropriate stopper rod position corresponding to the solved value for area A. The value of A is approximate since during a particular pour, certain elements of the equation are in fact not constant. In particular, the height of the metal bath h changes as the metal in the chamber is consumed and the coefficients of velocity and turbulence may change as a result of the change in h.

It is possible to measure these changing values so that they can be updated dynamically within the controller during the pour and used to update the above equation. However, this adds complication and expense to the pouring system and may still yield unsatisfactory results. Area A and flow rate R are directly related so that a robust control is achieved. Flow rate R varies exponentially as a function of head height h, making control of flow rate R more difficult.

A target flow rate in a typical casting application may range from about 3 lbs/sec to about 30 lbs/sec, for example. A maximum depth of the metal bath may be about 24 inches. In order to accommodate the ability to pour at 30 lbs/sec when the bath height is depleted down to 4 inches, a relatively large nozzle diameter is required in order to achieve the necessary area A. When pouring at the slower rate of 3 lbs/sec when the height of the metal bath is 24 inches, the stopper height over the nozzle necessary to achieve the desired value for area A is very small due to the large nozzle diameter. Under these conditions, the change in flow rate is very sensitive to minute changes in the stopper position. Consequently, the flow rate is hard to control and becomes inconsistent from pour to pour because of the variable head height. A further problem is that, at small stopper heights, the metal flow through the nozzle begins to roostertail due to an increased velocity.

Previous attempts have been made in stopper-controlled pouring systems to maintain a constant head height in the molten metal bath. However, these attempts have been impractical and required complicated and expensive apparatus. For example, pressurized displacement of molten metal from a main chamber into a pouring subchamber has been used to provide a constant head height. In addition to the added expense, such a system required frequent maintenance resulting in down time and loss of productivity.

In order to increase productivity, it is desirable to pour metal into molds as the molds are carried in a conveyor line without stopping as is described in U.S. Pat. No. 5,056,584. As shown in that patent, a pouring vessel is suspended by a moving carriage in order to synchronize its movement with the moving molds. In a moving system, the pouring unit must have good mobility and should be contained completely above the height of the top of the moving molds on their conveyor system. The weight, complexity, and space requirements of prior art pouring systems having constant head height, however, have been unsuitable for these moving applications.

SUMMARY OF THE INVENTION

The present invention achieves important advantages of well controlled molten metal flow through a nozzle by providing a constant head height with a cost effective and easily maintained pouring system. In particular, the vessel is tilted to an appropriate position during pouring such that the constant head height results.

In one aspect of the invention, a casting apparatus for pouring molten metal into molds comprises a vessel having a molten metal-receiving chamber generally extending between a filling end and a pouring end. The vessel includes a nozzle disposed in a bottom surface of the chamber proximate to the pouring end. A stopper cooperates with the nozzle to control a downward gravity flow of molten metal through the nozzle. A first support pivotably supports the vessel to provide a horizontal tilt axis substantially coincident with the nozzle. A second support is connected to the vessel at a point away from the tilt axis and has a drive for controlling a pivot position of the vessel. A tilt angle controller detects a level of molten metal within the chamber and engages the drive to maintain the level at a predetermined level.

DETAILED DESCRIPTION OF PREFERRED EMBODIMENTS

Figure 1:
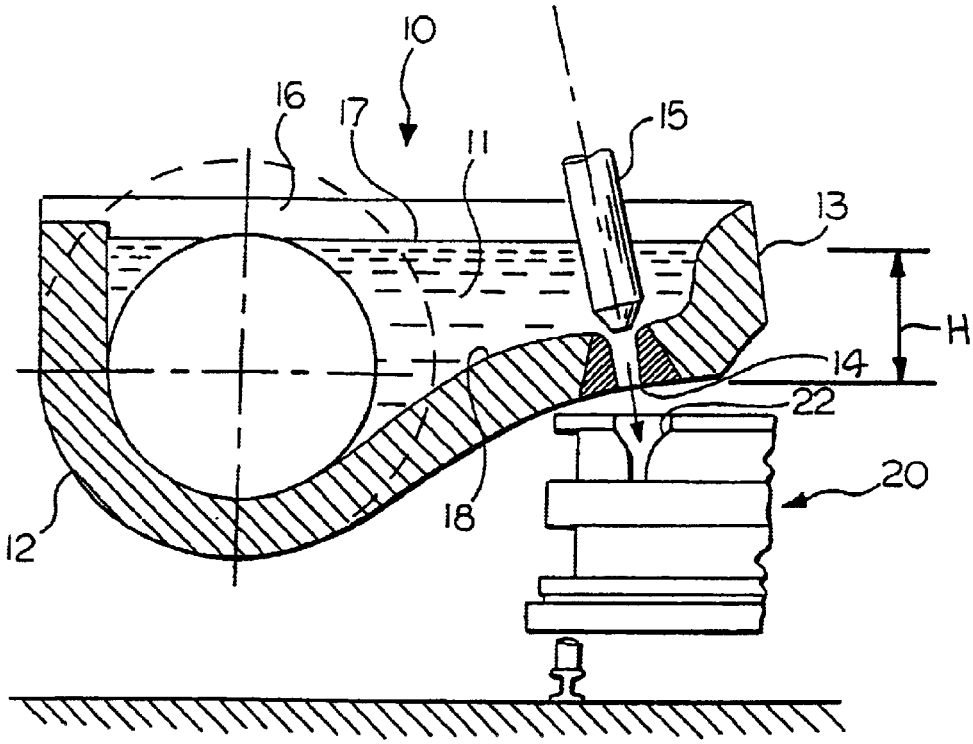
FIG. 1 is a side cross section showing a vessel of the present invention pouring molten metal into a mold.

Referring to FIG. 1, a vessel generally indicated at 10 comprises vessel walls formed of refractory-lined steel plates and enclosing a molten metal chamber 11 extending between a filling end 12 and a pouring end 13. A nozzle 14 is formed by an aperture in a bottom wall of vessel 10. Nozzle 14 can be opened and closed by a stopper rod 15 contoured to provide a seal with nozzle 14 when pressed together. Molten metal in chamber 11 is heated by an induction heating coil 16. Molten metal contained in vessel 10 has an upper surface 17 that rises and lowers as molten metal is supplied into vessel 10 and then poured out through nozzle 14, for example. Vessel 10 is tiltable to bring molten metal forward from filling end 12 to pouring end 13 as the amount of molten metal in vessel 10 is depleted. Preferably, a bottom surface 18 of chamber 11 is sloped to provide a generally decreasing depth of chamber 11 from filling end 12 to pouring end 13 (with reference to a nominal position of vessel 10 wherein the top of vessel 10 is horizontal). In other words, there is an increasing depth of chamber 11 with increasing distance from pouring end 13 so that the tilting of vessel 10 can controllably shift molten metal between filling end 12 and pouring end 13. While in the nominal, horizontal position, vessel 10 may have a molten metal capacity of about 1,500 to 8,000 pounds of iron, for example.

Vessel 10 is suspended over a mold flask 20 that moves in a production line. At the top of mold flask 20, a sprue cup 22 is aligned with nozzle 14 to receive a pour of molten metal. A mold cavity (not shown) receives the poured metal from sprue cup 22 via a plurality of passages (not shown) for distributing the molten metal.

Figure 2:
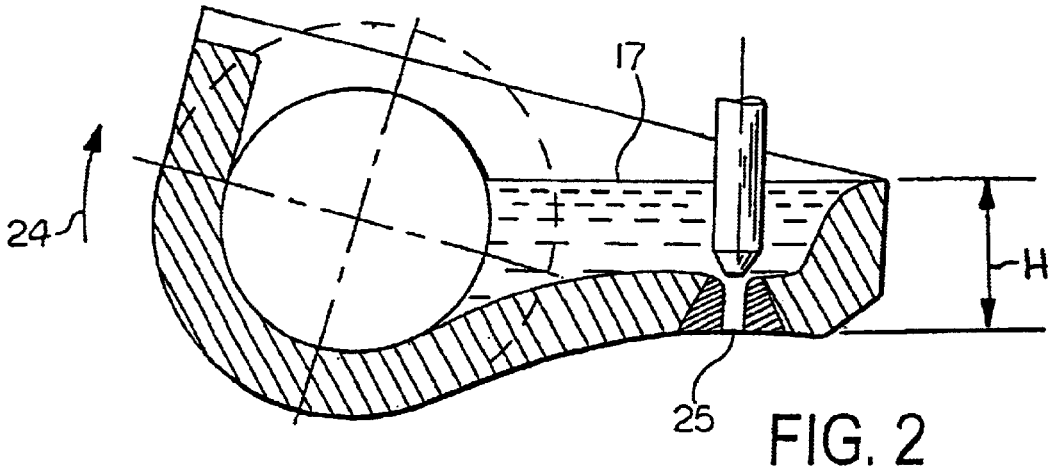
FIG. 2 is a side cross section of the vessel of FIG. 1 after increased tilting in order to maintain a predetermined level of molten metal in a substantially vertical column above the nozzle.

As shown in FIG. 2, vessel 10 can be tilted forward (i.e., raised up at its filling end) in order to move more molten metal from the filling end into the pouring end so that a constant head height (designated by reference character H in FIGS. 1 and 2), is maintained in the vessel 10 between the upper surface 17 of the molten metal and a nozzle exit 25 of the nozzle 14. Vessel 10 pivots in the direction of arrow 24 about a pivot axis that coincides the nozzle exit 25 and that is perpendicular to the plane of FIG. 2, whereby nozzle exit 25 maintains its position relative to the sprue cup of the mold underlying it. As more molten metal is refilled into vessel 10, it is tilted back down in the opposite direction in order to maintain a predetermined head height at all times during pouring of molten metal into molds.

Figure 3:
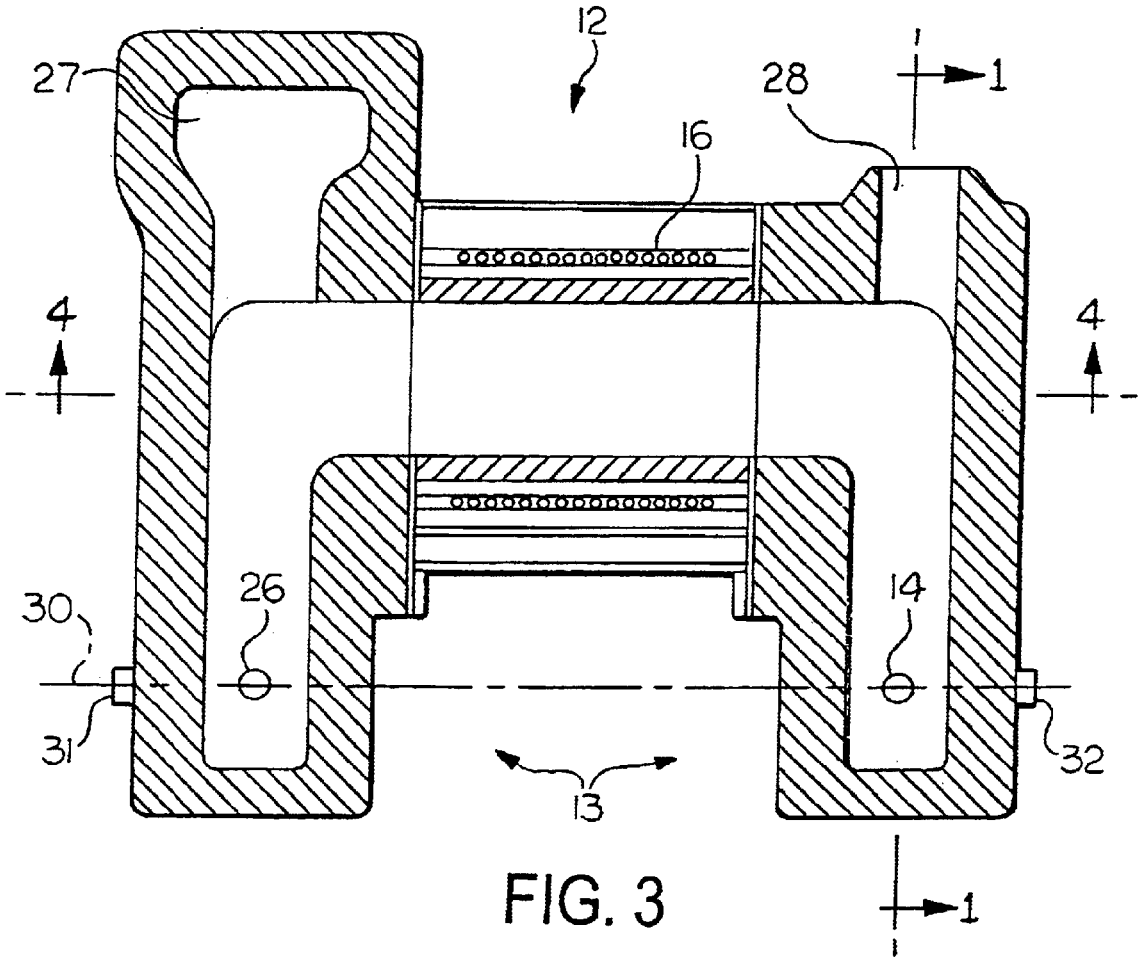
FIG. 3 is a top, plan view of the vessel of FIG. 1.
Figure 4:
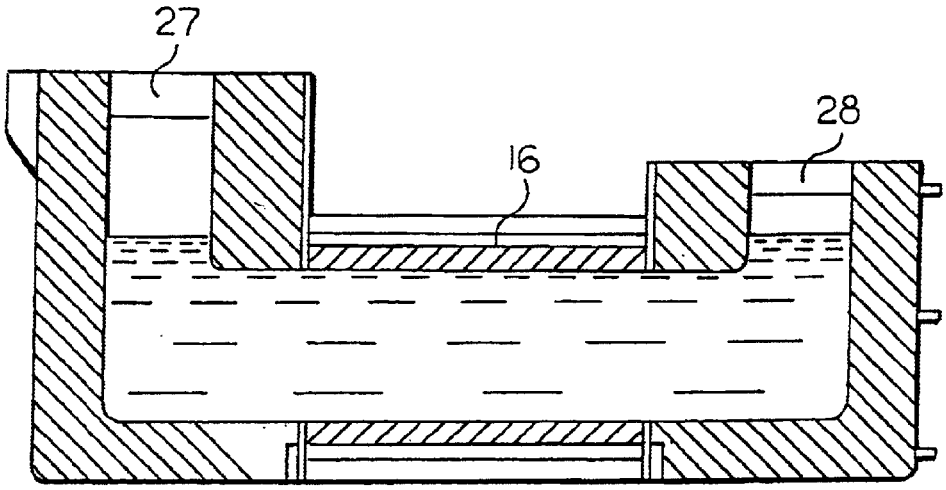
FIG. 4 is a front cross section of the vessel along lines 4—4 of FIG. 3.

As shown in FIGS. 3 and 4, vessel 10 may include two nozzle/stopper assemblies in opposite fingers of a "U-shaped" vessel. The bottom surface of the chamber in each finger preferably has the same sloped profile from the filling end 12 to the pouring end 13. The base of the "U" has a receiving trough 27 at one side and a pour-back trough 28 at the other side. Molten metal is charged into vessel 10 by pouring into receiving trough 27 from a launder system described with reference to FIG. 10. Vessel 10 is emptied of molten metal by reverse tilting to pour off metal through pour-back trough 28. Pour-back trough 28 is at a lower elevation than receiving trough 27 to ensure that pour back occurs only through pour-back trough 28. In an alternative embodiment, vessel 10 may instead have a filling orifice located in an area above nozzle 14 or 26 since the filling launder does not then have to take into account the variations in the height of vessel 10 during tilting.

Figure 5:
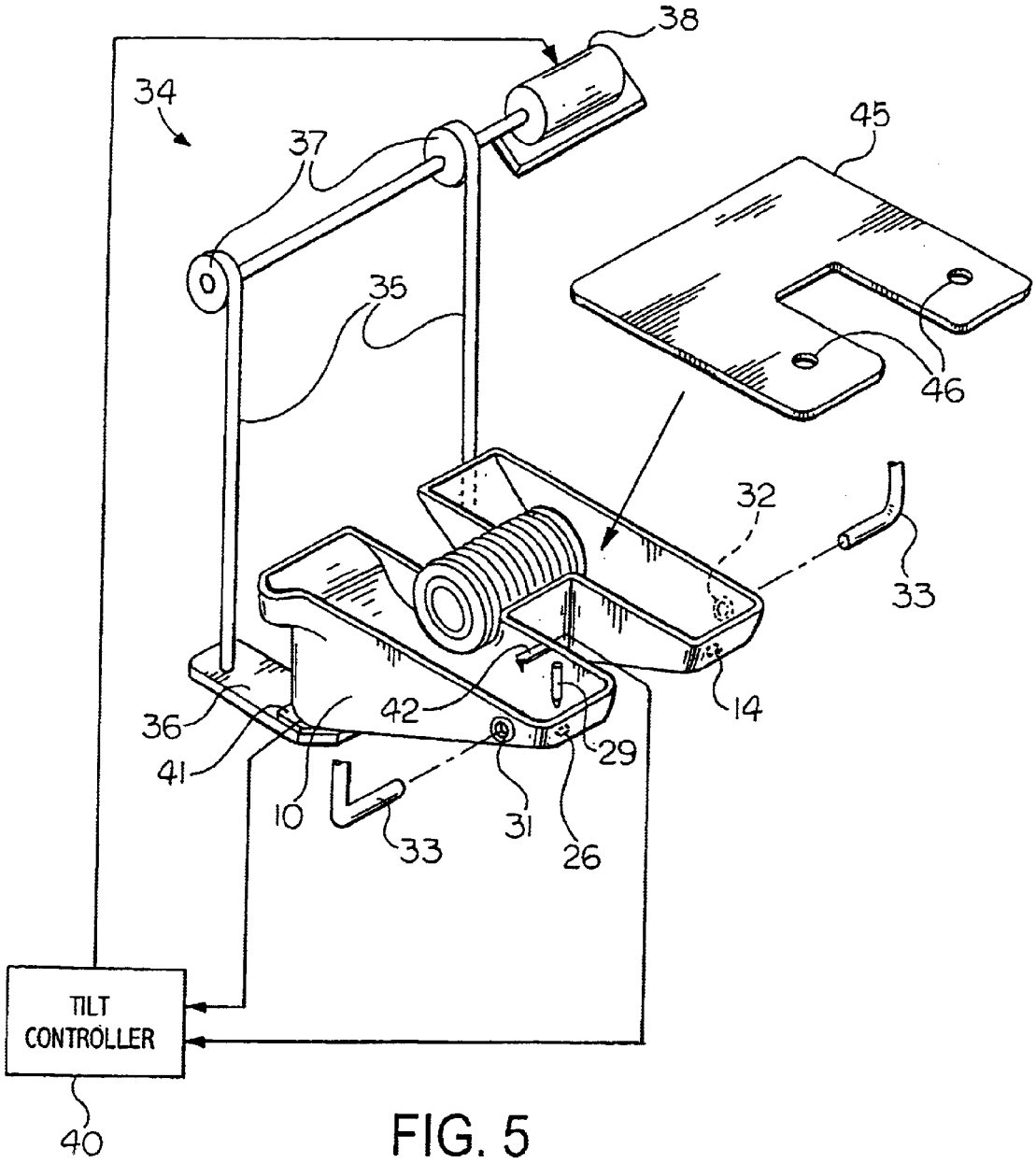
FIG. 5 is a front, left, top perspective view of the vessel of FIG. 1.

FIG. 5 shows a perspective view of vessel 10 including apparatus for supporting and controllably tilting the vessel. Substantially coincident with the pivot axis 30 through nozzles 14 and 26, a pair of pivot bearings 31 and 32 are affixed to the outsides of vessel 10. The bearings mate with a pair of trunnions 33 that are suspended from a movable carriage (not shown) for pivotably supporting the pouring end of vessel 10. The filling end of vessel 10 is supported by a hoist 34 for controllably raising and lowering the filling end to achieve a pivot position that maintains the molten metal level at a predetermined level at the pouring end of vessel 10. Hoist 34 may, for example, comprise a pair of cables 35 attached between a support plate 36 mounted to vessel 10 and a pair of reels 37 mounted to the movable carriage. A hydraulic or electric motor 38 coupled to reels 37 rotates to take up or pay out cables 35 under control of a tilt controller 40 as a closed loop feedback control. The level of molten metal can be determined by weighing the vessel contents using a load cell 41 upon which the hoist may be mounted. Knowing the weight and density of the molten metal, tilt controller 40 can determine the volume of molten metal. Since the geometry of the vessel chamber is known, tilt controller 40 can infer the level of the molten metal surface. Load cell 41 could alternatively be placed between hoist 34 and the moving carriage.

In yet another embodiment, the molten metal surface can be directly measured using a laser sensor 42 mounted above the molten metal batch near a stopper rod 29. For example, laser sensor 42 can be mounted to a side wall of vessel 10 or to a vessel cover 45 in the vicinity of a stopper rod aperture 46. Laser sensor 42 optically determines the head height of molten metal and provides a corresponding signal to tilt controller 40. Laser sensor 42 can be comprised of a laser distance sensor of the type commercially available from SICK AG, of Waldkirch, Germany, for example.

Figure 6:
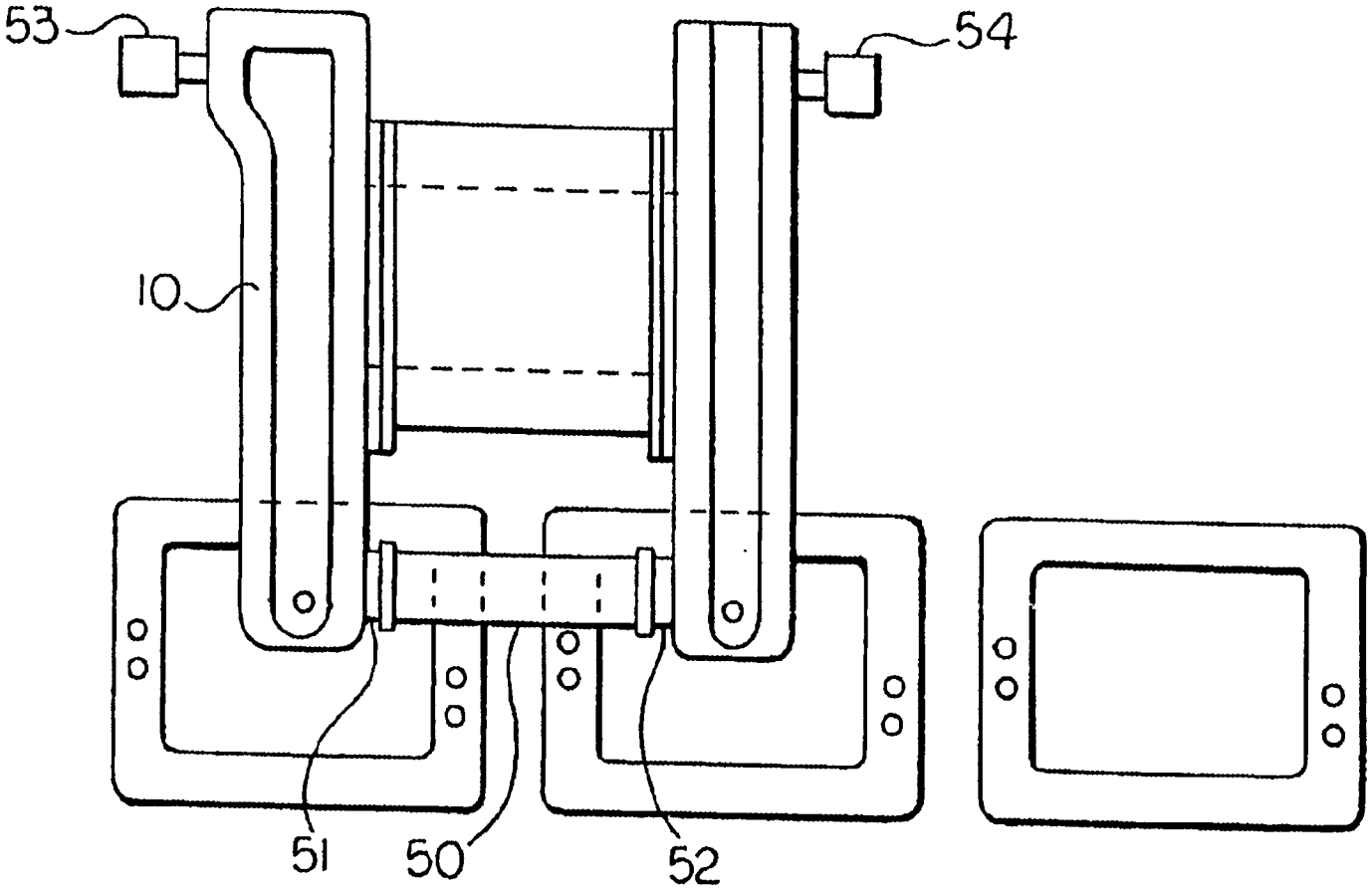
FIG. 6 is a top, plan view of the vessel of FIG. 1 showing an alternative embodiment for suspending the vessel.
Figure 7:
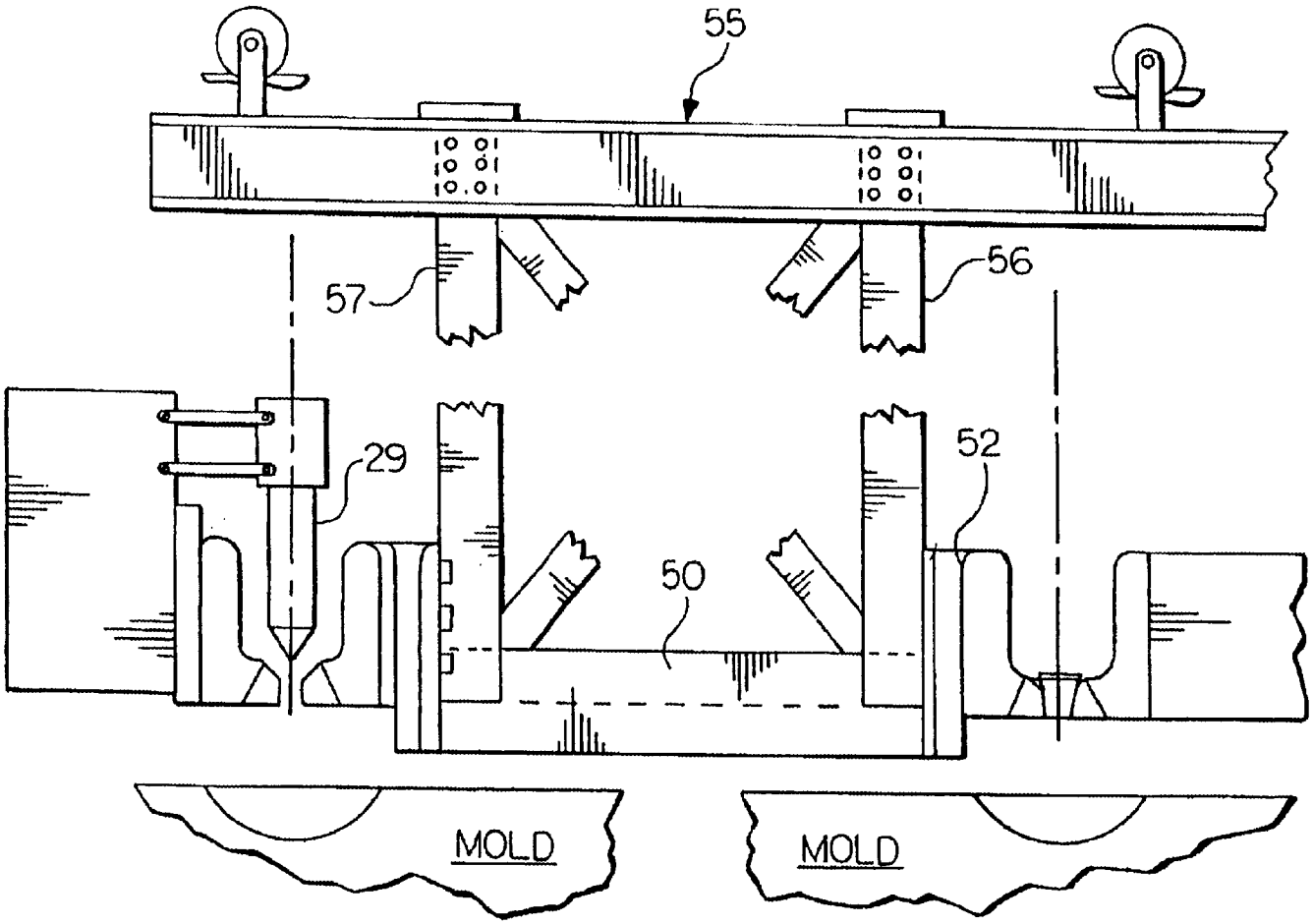
FIG. 7 is a front, plan view of the vessel of FIG. 6.

Another embodiment for suspending vessel 10 is shown in FIGS. 6 and 7. A trunnion rod 50 extends between bearings 51 and 52 mounted on the inward facing outer walls of the vessel fingers. A pair of support arms 53 and 54 extend from opposite sides at the filling end of vessel 10 for attachment to a hoist mechanism. A moving carriage 55 includes support beams 56 and 57 for securing trunnion rod 50.

Figure 8:
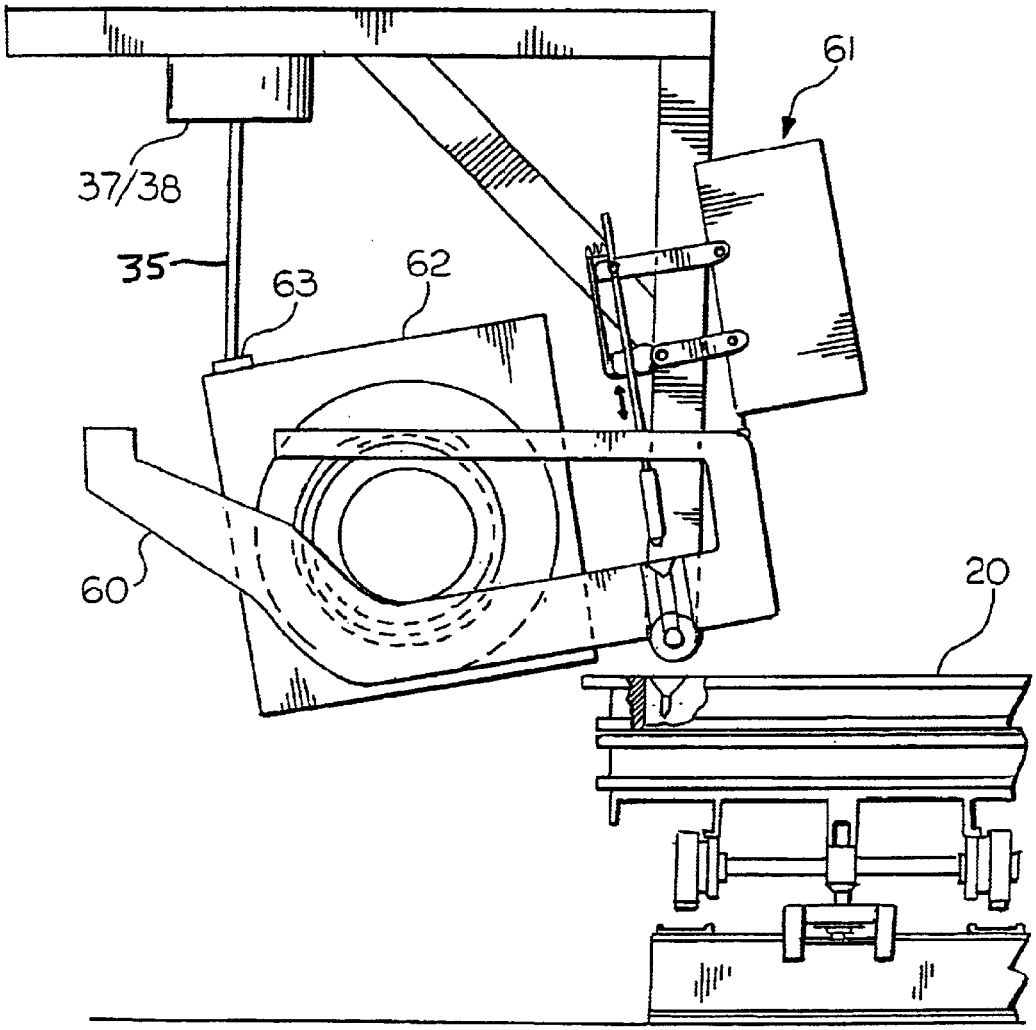
FIG. 8 is a side view showing an alternative embodiment of a vessel of the present invention.

In the further embodiment shown in FIG. 8, a vessel 60 has a stopper mechanism 61 mounted thereon. Vessel 60 including the coreless induction heater may be comprised of the Horizontal Coreless Auto Pour (HCAP) system available from Hayes-Lemmerz International-Equipment and Engineering, Inc., in AuGres, Mich. Stopper mechanism 61 can, for example, be comprised of the commercially available Seaton model 676EC stopper unit. A frame 62 is attached to vessel 60 and has a load cell 63 attached thereto. Vessel 60 is connected to the hoist via load cell 63. Even if a laser sensor is employed to measure head height, a load cell may still be desirable to estimate the weight of molten metal is vessel 60 in order to control refilling of metal.

Figure 9:
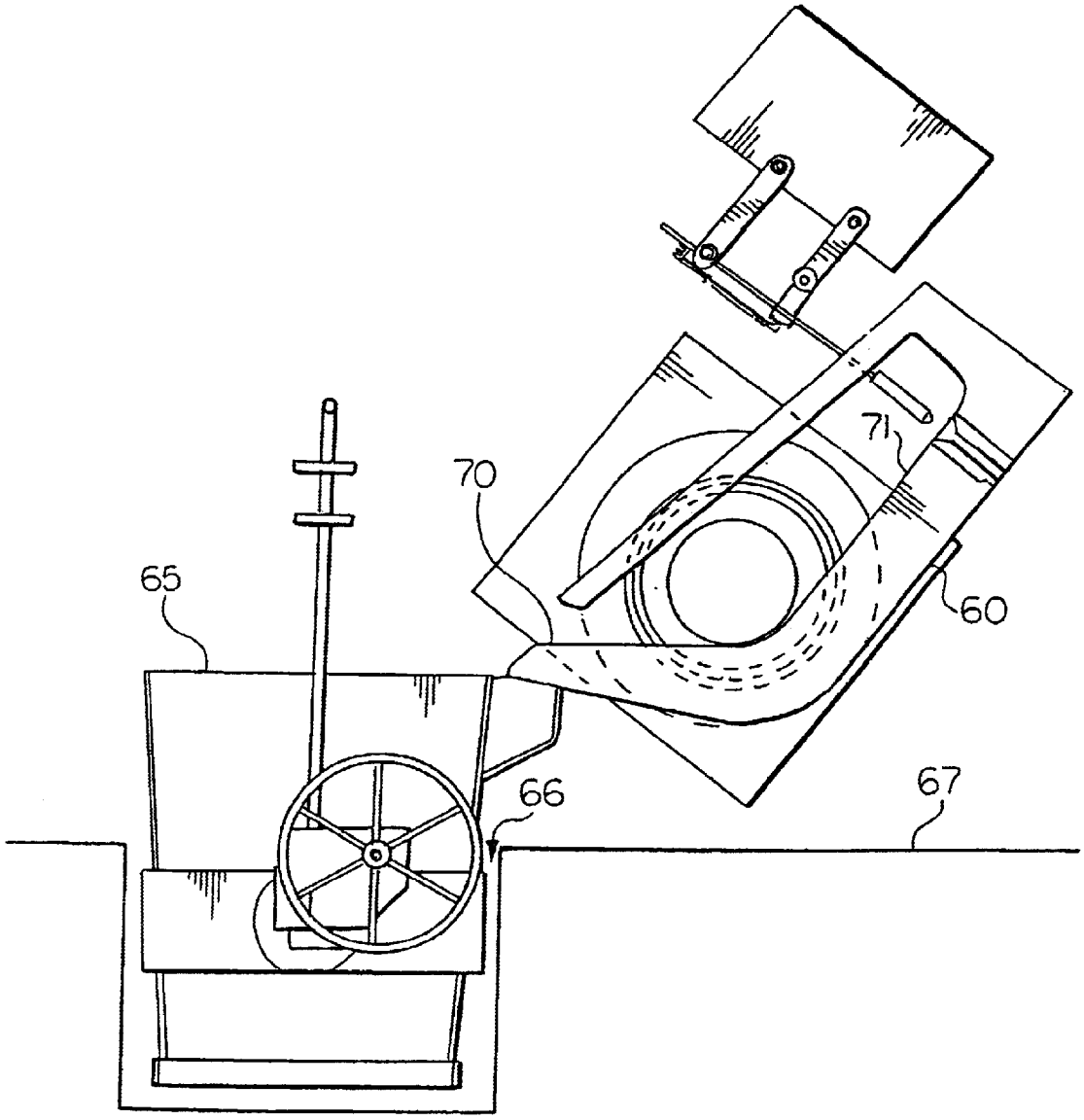
FIG. 9 is a side view of the vessel of FIG. 8 raised into position for pigging off molten metal not to be poured into a mold.

Vessel 60 is preferably incorporated into a movable pouring system such as the Mobl-Pour automatic pouring system available from Hayes-Lemmerz International-Equipment and Engineering, Inc. Vessel 60 can be moved parallel to a mold line direction in synchronization with a moving mold to position the stopper nozzle(s) over the sprue cup(s) of the mold. It can be moved parallel to the mold line direction for alignment with the sprue cups and to move off of the line for cleaning of the stopper nozzles or other maintenance and for pigging or dumping the contents of vessel 60. Thus, the tilting motion of vessel 60 permits tilting to the position shown in FIG. 9 wherein molten metal is back-poured into a bull ladle 65 contained in a pit 66 in floor 67. The range of tilting motion can be defined in relation to chamber surfaces comprising a sloped back wall 70 and a sloped bottom surface 71. During pigging, vessel 60 pivots to the point where wall 70 has rotated just past horizontal so that all molten metal flows out into bull ladle 65 (e.g., for return to a main furnace). During pouring of molds, vessel 60 needs to pivot no farther than a point where bottom surface 71 has rotated just past horizontal in order to supply all molten metal available to the pouring end of vessel 60. However, tilting to this extreme during pouring will not typically occur because the main chamber of vessel 60 will be frequently refilled so that the constant head height can be maintained.

Figure 10:
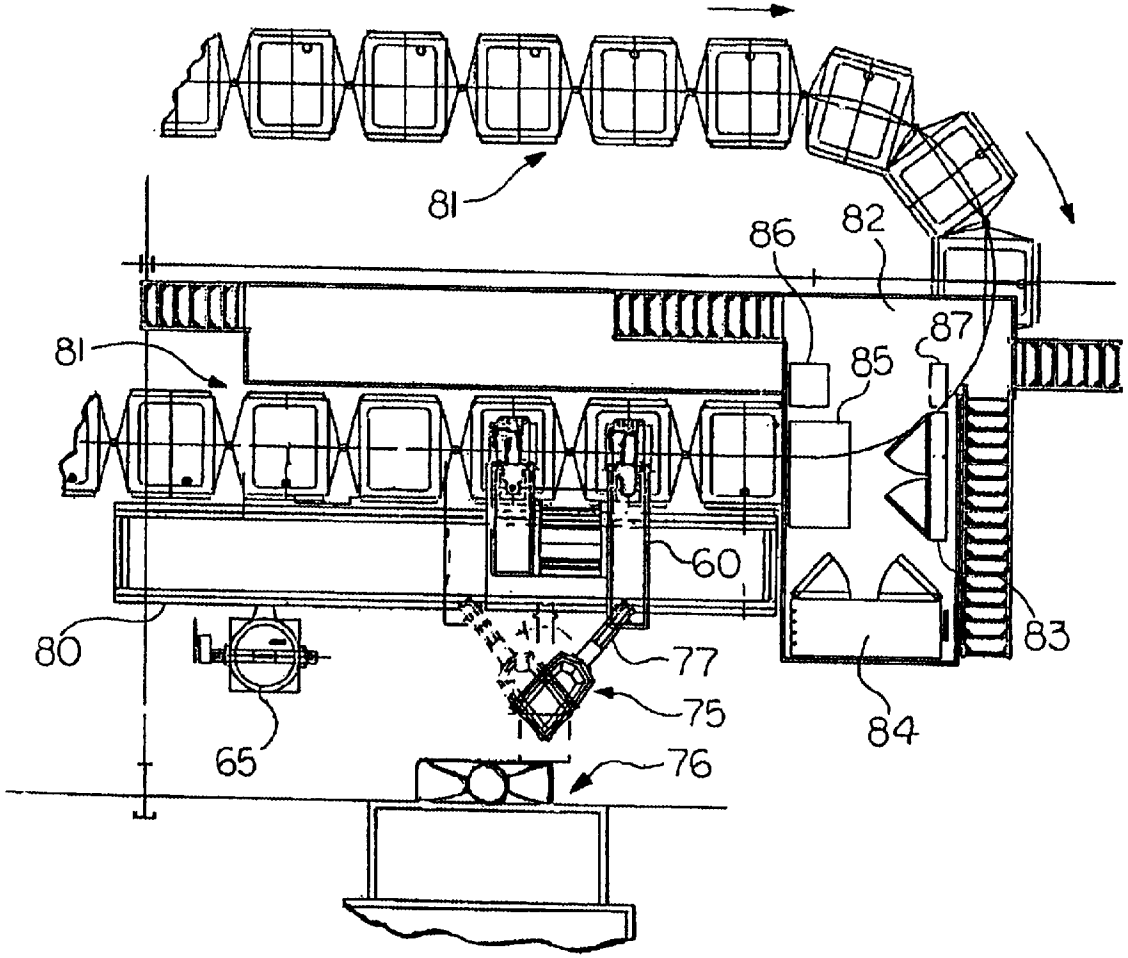
FIG. 10 is a top, plan view of a factory floor layout for a casting system of the present invention.

FIG. 10 shows a top view of a portion of a factory layout for the tilt pouring system of the present invention. Molten metal is replenished into vessel 60 by an articulated launder system 75 which transfers the molten metal from a main furnace 76 to vessel 60 via a launder trough 77. A gantry system 80 provides a rail system for the moving carriage carrying the pouring vessel and its support structures in order to follow molds on conveyor line 81. A service platform 82 contains support and control equipment including an electrical control panel 83, an inductor power unit 84, a hydraulic power unit 85, a water cooling system 86, and a pneumatic panel 87.

In view of the foregoing description, the present invention has provided a noncomplex, inexpensive solution to providing a constant head height of molten metal in a movable pouring system. Nozzle design and selection is greatly facilitated since a wide range of head heights does not need to be addressed. A more laminar flow can also be achieved because the nozzle can be better customized to the constant head height, and the roostertail problem is avoided. Furthermore, a shorter stopper rod can be used, which allows better stability of the vessel when molten metal is pouring in from the launder.

What is claimed is:

1. A casting apparatus for pouring molten metal into molds, comprising:

a vessel having a molten metal-receiving chamber generally extending between a filling end and a pouring end, said vessel including a nozzle disposed in a bottom surface of said chamber proximate to said pouring end;

a stopper cooperating with said nozzle to control a downward gravity flow of molten metal through said nozzle;

a first support for pivotably supporting said vessel to provide a horizontal tilt axis substantially coincident with said nozzle;

a second support connected to said vessel at a point away from said tilt axis and having a drive for controlling a pivot position of said vessel; and a tilt angle controller detecting a level of molten metal within said chamber and engaging said drive to maintain said level of said molten metal within said chamber at a generally constant head height defined between an upper surface of the molten metal and a nozzle exit of said nozzle.

2. The apparatus of claim 1 wherein said tilt angle controller includes an optical reflection sensor for sensing said head height.

3. The apparatus of claim 1 wherein said tilt angle controller includes a weight sensor for determining a weight of molten metal contained in said chamber, said tilt angle controller inferring said head height in response to said determined weight.

4. The apparatus of claim 1 wherein said first support comprises pivot bearings and at least one trunnion aligned with said tilt axis.

5. The apparatus of claim 1 wherein said second support is comprised of a hoist connected to said vessel substantially at said filling end.

6. The apparatus of claim 1 wherein said bottom surface of said chamber provides a generally increasing depth of said chamber with increasing distance from said pouring end.

7. The apparatus of claim 1 wherein said vessel includes a receiving trough for accepting molten metal into said chamber and a pour-back trough for dumping molten metal from said chamber, said pour-back trough being at a lower elevation than said receiving trough.

8. The apparatus of claim 1 further comprising a coreless induction heater disposed around said vessel intermediate said filling end and said pouring end.

9. The apparatus of claim 1 comprising a plurality of nozzles and corresponding stoppers for simultaneously pouring molten metal into respective mold sprue cups, each of said nozzles being substantially coincident with said horizontal tilt axis.

10. The apparatus of claim 1 wherein said vessel is movable laterally to follow a moving mold.

11. A method of pouring molten metal into a mold comprising the steps of:

transferring molten metal into a vessel having a molten metal-receiving chamber generally extending between a filling end and a pouring end, said vessel including a nozzle disposed in a bottom surface of said chamber proximate to said pouring end, wherein a stopper cooperates with said nozzle to control a downward gravity flow of molten metal through said nozzle;

pivotally supporting said vessel to provide a horizontal tilt axis substantially coincident with said nozzle;

locating said nozzle above a sprue cup of said mold;

controlling a position of said stopper relative to said nozzle to provide a variable flow rate during filling of said mold; and controlling a tilt of said vessel to maintain a level of said molten metal within said chamber at a generally constant head height defined between an upper surface of the molten metal and a nozzle exit of said nozzle so that said step of controlling said position of said stopper need not compensate for any changes in said level of molten metal.

12. The method of claim 11 wherein said step of controlling said tilt is comprised of the steps of:

detecting said level of molten metal within said chamber; and engaging a drive for controlling a pivot position of said vessel about said horizontal tilt axis so as to maintain said level at said generally constant head height.

13. The method of claim 12 wherein said detecting step is comprised of optically measuring a location of a surface of said molten metal.

14. The method of claim 12 wherein said detecting step is comprised of measuring a weight of said molten metal within said chamber and inferring said level in response to a geometry of said chamber and a volume of said molten metal.

15. The method of claim 11 wherein said bottom surface of said chamber provides a generally increasing depth of said chamber with increasing distance from said pouring end.

16. The method of claim 11 further comprising the step of:

heating said molten metal in said chamber intermediate said filling end and said pouring end using a coreless induction heater.

17. The method of claim 11 wherein said vessel is supported on a moving carriage for following said mold as it moves down a conveyor.

18. The method of claim 11 wherein said vessel includes a plurality of nozzles for simultaneously pouring said molten metal into respective sprue cups.

* * * * *